US006155176A

United States Patent [19]

Checketts

[11] Patent Number: 6,155,176

[45] Date of Patent: Dec. 5, 2000

[54] RACING AMUSEMENT RIDE

[76] Inventor: Stanley J. Checketts, 900 E. Canyon Rd., Providence, Utah 84332

[21] Appl. No.: 08/915,526

[22] Filed: Aug. 15, 1997

[51] Int. Cl.[7] ..... A63G 25/00

[52] U.S. Cl. ..... 104/53; 104/60; 104/242; 104/245; 104/247; 104/124; 188/38; 188/43

[58] Field of Search ..... 104/53, 59, 60, 104/69, 70, 72, 73, 242, 249, 250, 252, 254, 257, 258, 259, 245, 247, 124; 188/38, 38.5, 41, 43, 44, 45; 472/85

[56] References Cited

U.S. PATENT DOCUMENTS

| | | | |
|---|---|---|---|
| 1,204,189 | 11/1916 | Rawie | 104/259 |
| 1,702,091 | 2/1929 | Sellner | 104/69 |
| 2,687,304 | 8/1954 | Northrop et al. | 104/53 |
| 4,201,137 | 5/1980 | Lagsdin | 104/69 |
| 4,236,454 | 12/1980 | Erickson et al. | 104/69 |
| 4,246,846 | 1/1981 | Betschart | 104/69 |
| 4,991,514 | 2/1991 | Powell et al. | 104/60 |
| 5,361,705 | 11/1994 | Powell | 104/60 |
| 5,551,347 | 9/1996 | Gutknecht | 104/60 |

FOREIGN PATENT DOCUMENTS

| | | | |
|---|---|---|---|
| 2150245 | 4/1973 | Germany | 188/43 |
| 1108863 | 4/1968 | United Kingdom | 104/259 |

*Primary Examiner*—Mark T. Le
*Attorney, Agent, or Firm*—Thompson E. Fehr

[57] ABSTRACT

A racing-type amusement ride utilizes a self-propelled vehicle which has guide wheels to move along a track having a beginning end, a finish end, a first lateral side, a second lateral side, a top, a rail along which a guide wheel of the self-propelled vehicle runs situated on the top of the track, and attached to at least one lateral side of said track between the beginning end of the track and the finish end of the track a frictional strip. Deceleration of the self-propelled vehicle is accomplished by having at least one brake pad so attached to the self-propelled vehicle that such brake pad will come into contact with a frictional strip.

27 Claims, 3 Drawing Sheets

RACING AMUSEMENT RIDE

BACKGROUND OF THE INVENTION

1. Field of the Invention

This invention relates to an amusement ride, especially the type of ride where a participant is located within a self-propelled vehicle to enjoy the sensation of speed as the vehicle moves.

2. Description of the Related Art

Two patents are known to exist for self-propelled vehicles which ride on a track and are guided by a fin which extends downward into a central groove within a track. These patents are U.S. Pat. No. 5,551,347 of Leroy H. Gutknecht and U.S. Pat. No. 5,575,218 of Tyrone E. Powell.

The claims of the Gutknecht patent simply refer to a "vehicle" and describe neither such vehicle nor its source of propulsion. The disclosure for that patent, however, indicates that the intent of the invention of that patent was to "construct an amusement ride incorporating a dragster type of vehicle" and that "[a] dragster type of vehicle is an automobile . . . . " The claims and the disclosure of the Powell patent declare that the vehicle is electrically powered, and the disclosure states that "[t]he present invention comprises cars that are accurate representations of real pro-stock drag racers . . . . "

Despite the fact that the Gutknecht patent does not explicitly provide the operator of the amusement ride (as opposed to the participant within the vehicle) with the ability to control the throttle of the vehicle in order to terminate propulsion, it is understood that the actual amusement rides which are based upon the Gutknecht patent do have this feature in a form which can be utilized by the operator in emergency situations; and the Gutknecht patent does assert, "Another objective of the present invention is to construct an amusement ride which can be operated in total safety for the operating human even in the event that the human is not able to operate the vehicle." Similarly, the Powell patent, though not incorporating the potential for the operator to control the throttle, does indicate that "[f]or safety, DC power to the motors can be interrupted by the race controller at any time during a race."

And although the Gutknecht patent neither claims nor discloses a method for returning the vehicle to its starting position on the track, the Powell patent does disclose "a pivot cylinder . . . with a rod passing through a guide bogie" as a "means for rotating the car . . . 180 degrees at each end of the track . . . . "

Both the Gutknecht patent and the Powell patent disclose pneumatic brakes mounted in the track which close to grasp the downward extending fin when it is desired to brake the vehicle. Brakes similar to those of the Gutknecht patent are, furthermore, claimed in U.S. Pat. No. 5,575,218 of Leroy H. Gutknecht.

A number of patents, moreover, have been granted for vehicles (other than "race cars") the brakes for which operate in a manner opposite to the brakes of Gutknecht and Powell. In U.S. Pat. Nos. 4,195,576; 4,221,170; 4,236,454; 4,246,846; and 4,335,658 a brake pad is maintained some distance from a track upon which a vehicle is moving until it is desired to slow or stop the vehicle, when the brake pad is forced against the track (by means of a lever except for the case of U.S. Pat. No. 4,195,576, the invention of which utilizes a hydraulic cylinder for this purpose). And the device of U.S. Pat. No. 4,014,413 has a brake which functions similarly to those of the series of patents discussed earlier within this paragraph; the vehicle (a mining machine) does not, however, travel upon the track but "moves along a path adjacent to . . . [the] anchored rail . . . . "

The System for Halting Runaway Electrically Powered Train in U.S. Pat. No. 3,858,524 of Roy C. Stones provides a braking effect which does not require an individual to operate a control device such as a lever or a hydraulic cylinder. A U-shaped skid block is mounted beneath a train and has brake lining material on its surface. Extending parallel to the track upon which the train rides is a "split skid track." The "split skid track," itself, incorporates two rails which are urged apart from one another by springs. Only in the drawings is it shown that the end of the "split skid track" is pointed or rounded to facilitate entry of the "split skid track" into the U-shaped skid block. Even so, such entry will be accomplished only if the train remains properly aligned upon the track on which the train is running.

SUMMARY OF THE INVENTION

The present invention is not limited to two parallel, straight tracks but may incorporate any number of tracks in any configuration; may be either a closed course (such as an oval) or an open, straight course; and may even run uphill to simulate a "hill climb."

Since the vehicle of the present invention, in its preferred embodiment, is a snowmobile, the hill climb—a contest in which snowmobiles often compete—is especially appropriate.

On any version of the track, the open nature of a snowmobile (as opposed to the enclosed cockpit of a drag racer) adds to the exciting sensation of the amusement ride.

The present invention, moreover, incorporates, in the vehicle, a sensor which is preferably routinely and automatically activated—as opposed to utilizing the intervention of the ride operator in emergency situations—near the end of an open-course track to deactivate the throttle and terminate propulsion of the vehicle.

Optionally, a remote control may be incorporated to cause the self-propelled vehicle to operate in a reverse direction and return from a position near the finish of an open-track course to the beginning of such course.

A guide maintains the vehicle in alignment with the track. In the preferred embodiment, this is accomplished by replacing a first ski of a snowmobile with one or more guide wheels. The guide wheel(s) run along a first rail situated on the top of the track, preferably near a first lateral side of the track.

Probably the most unique feature of the present invention is, however, its braking system. Between the first (beginning) end and the second (finish) end of the track a first frictional strip is attached to a first lateral side of the track. This first frictional strip continues along the first lateral side of the track toward the second end of the track. Preferably, a second frictional strip is similarly attached to a second lateral side of the track. A first brake pad is attached to the vehicle in such a manner that when the vehicle is maintained in alignment with the track, the first brake pad contacts the first frictional strip to produce a braking force. Similarly, in the preferred embodiment, a second brake pad attached to the vehicle contacts the second frictional strip to increase the braking force. Moreover, should the vehicle begin to move out of alignment on the track toward one lateral side of the track, greater pressure and, therefore, greater friction will be generated by the brake pad and its associated frictional strip on the lateral side of the track away from the direction of movement, which will result in forcing the vehicle back toward proper alignment on the track.

To assist the braking system in stopping the vehicle, the throttle may be deactivated by remote control.

In order to return the vehicle to its initial position on an open course, the brake pads are moved away from the lateral sides of the track and an auxiliary throttle lever is activated to cause the vehicle to move in reverse.

On an open course, an auxiliary brake, which spans the track, may be employed to assure that the vehicle does not continue past the finish and leave the track.

DESCRIPTION OF THE PREFERRED EMBODIMENT

Figure 1:
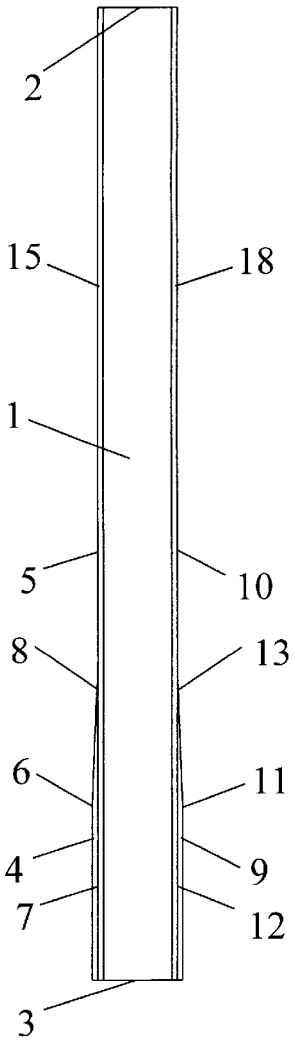
FIG. 1 presents an overhead view of an open-course track utilized within this invention.

The Racing-type Amusement Ride utilizes one or more (preferably two) tracks 1, as illustrated in FIG. 1. When there is more than one track 1, the tracks 1 are essentially parallel to one another but may be in any configuration and may be either a closed course (such as an oval) or an open, straight course similar to those of the devices in the Gutknecht and Powell patents; and may even run uphill to simulate a "hill climb."

A self-propelled vehicle 36 is associated with each track 1. In embodiment, the self-propelled vehicle is a modified snowmobile.

Each self-propelled vehicle accelerates from a first (beginning) end 2 of its associated track 1 toward a second (finish) end 3 of said track 1. Of course, the self-propelled vehicle is decelerated and stopped before reaching the finish end 3 of the track 1 when the track forms an open course. And, in the case of a closed course, the finish end 3 of the track 1 will adjoin the beginning end 2 of the track 1.

Two techniques are employed to accomplish the deceleration and stopping.

Figure 2:
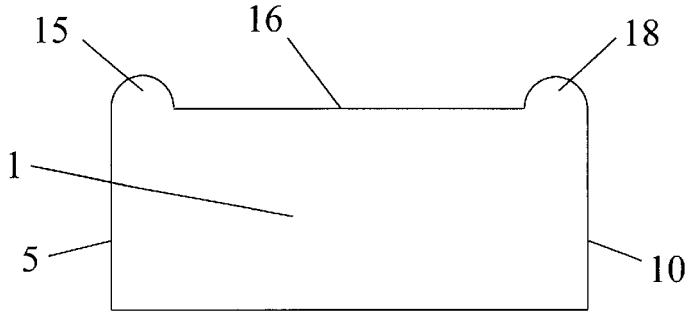
FIG. 2 shows the transverse cross section of the track.
Figure 3:
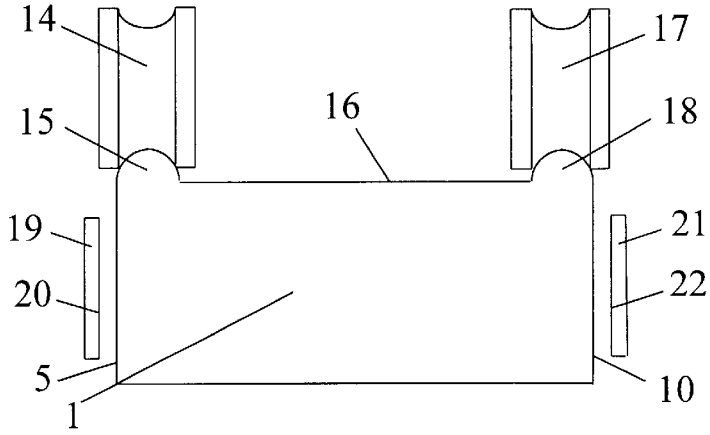
FIG. 3 is a transverse cross-sectional view depicting the relationship of the guide wheels and the brake pads on the self-propelled vehicle in relation to a cross section of the track where no frictional strips have been incorporated.
Figure 4:
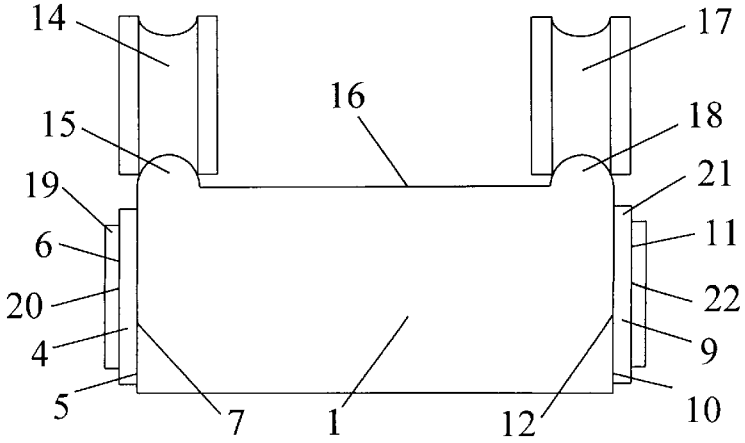
FIG. 4 is a transverse cross-sectional view showing the relationship of the guide wheels and the brake pads on the self-propelled vehicle in relation to a cross section of the track where frictional pads have been attached to both lateral sides of the track.

As depicted in FIG. 2, FIG. 3, and FIG. 4, the track 1 has a generally rectangular cross section.

Between the beginning end 2 and the finish end 3 of the track 1 a first frictional strip 4 is attached to a first lateral side 5 of the track 1. This first frictional strip 4 continues along the first side 5 of the track 1 toward the finish end 3 of the track 1. Preferably, the outer side 6 of the first frictional strip 4 tapers toward the inner side 7 of the first frictional strip 4 and meets said inner side 7 at the first end 8 of the first frictional strip 4.

Preferably, between the beginning end 2 and the finish end 3 of the track 1 a second frictional strip 9 is similarly attached to a second lateral side 10 of the track 1. This second frictional strip 9 continues along the second lateral side 10 of the track 1 toward the finish end 3 of the track 1. Preferably, the outer side 11 of the second frictional strip 9 tapers toward the inner side 12 of the second frictional strip 9 and meets said inner side 12 at the first end 13 of the second frictional strip 9.

The self-propelled vehicle is maintained in alignment with the track 1 by a guide. In the preferred embodiment, this is accomplished by replacing a first ski (not shown) of a snowmobile (not shown) with one or more guide wheels 14. The guide wheels 14 run along a first rail 15 situated on the top 16 of the track 1, preferably near the first lateral side 5 of the track 1.

Although the second ski (not shown) could be replaced with a standard wheel that is well known in the art, such second ski is preferably replaced with one or more guide wheels 17. And a second rail 18 is preferably situated on the top 16 of the track 1, preferably near the second lateral side 10 of the track 1. The guide wheels 17 run along the second rail 18.

A first brake pad 19 is attached to the self-propelled vehicle in such a manner that the first brake pad 19 is urged in any manner that is well known in the art—for example, by a resilient member 35 as depicted in FIG. 3 such as a spring or air cylinder—toward the first lateral side 5 of the track 1 to such an extent that when the self-propelled vehicle is maintained in alignment with the track 1, the inner surface 20 of the first brake pad 19 will attain a position—in the absence of the first frictional strip 4—that is intermediate between the first lateral side 5 of the track 1 and the position where the outer side 6 of the first frictional strip 4 would be located were such first frictional strip 4 installed.

Consequently, once the self-propelled vehicle—in moving toward the finish end 3 of the track 1—reaches the first frictional strip 4, the frictional force between the inner surface 20 of the first brake pad 19 and the outer side 6 of the first frictional strip 4 will produce a braking force to decelerate and stop the self-propelled vehicle.

Preferably, a second brake pad 21 is attached to the self-propelled vehicle in such a manner that the second brake pad 21 is urged in any manner that is well known in the art—for example, by a resilient member 35 as depicted in FIG. 3 such as a spring or air cylinder—toward the second lateral side 10 of the track 1 to such an extent that when the self-propelled vehicle is maintained in alignment with the track 1, the inner surface 22 of the second brake pad 21 will attain a position—in the absence of the second frictional strip 9—that is intermediate between the second lateral side 10 of the track 1 and the position where the outer side 11 of the second frictional strip 9 would be located were such second frictional strip 9 installed. (It is possible, though, to eliminate the urging means in the case of the second brake pad 21.)

Consequently, once the self-propelled vehicle—in moving toward the finish end 3 of the track 1—reaches the second frictional strip 9, the frictional force between the inner surface 22 of the second brake pad 21 and the outer side 11 of the second frictional strip 9 will produce a braking force to decelerate and stop the self-propelled vehicle.

Moreover, when both a second brake pad 21 and a second frictional strip 9 are utilized, should the self-propelled vehicle begin to move out of alignment on the track toward one lateral side of the track, greater pressure and, therefore, greater friction will be generated by the brake pad 19 or 21 and its associated frictional strip 4 or 9 on the lateral side 5 or 10 of the track 1 away from the direction of movement and will necessarily force the self-propelled vehicle back toward a proper alignment on the track 1.

On a closed course, any means that is well known in the art may be utilized either (a) to move the first brake pad 19 away from the first lateral side 5 of the track 1 and the second brake pad 21 away from the second lateral side 10 of the track 1 each time the self-propelled vehicle approaches the frictional strips 4, 9 until it is desired to stop the self-propelled vehicle or (b) to maintain the brake pads 19, 21 away from the frictional strips 4, 9 until it is desired to stop the self-propelled vehicle, at which time the brake pads 19, 21 will be moved into position to contact the frictional strips 4, 9.

In order to return the self-propelled vehicle to its initial position, any means that is well known in the art, such as the lever assembly 41, is used to move the first brake pad 19 away from the first lateral side 5 of the track 1 and the second brake pad 21 away from the second lateral side 10 of the track 1. Preferably, such action with respect to the lever assembly 41 also deactivates the throttle 39. To then cause the self-propelled vehicle to move toward its initial position on the track 1, an auxiliary throttle lever (40) is used to permit the throttle 39 to open a sufficient amount, preferably just above the idle setting, to permit the self-propelled vehicle to return to its initial position. (Of course, such self-propelled vehicle would have to include a device, such as a gear shift and transmission, that is well known in the art and customarily included in vehicles such as snowmobiles, to permit the engine of the self-propelled vehicle to power the selfpropelled vehicle in a reverse direction, i.e., from the finish end 3 of the track 1 toward the beginning end 2 of the track 1.) Either an operator rides the vehicle back to the initial position and deactivates the throttle 39 by deactivation device 38 to stop the vehicle or the unoccupied slow moving vehicle strikes a bumper near its initial position at which time an operator located near the initial position reaches into the vehicle and deactivates the throttle 39.

Figure 5:
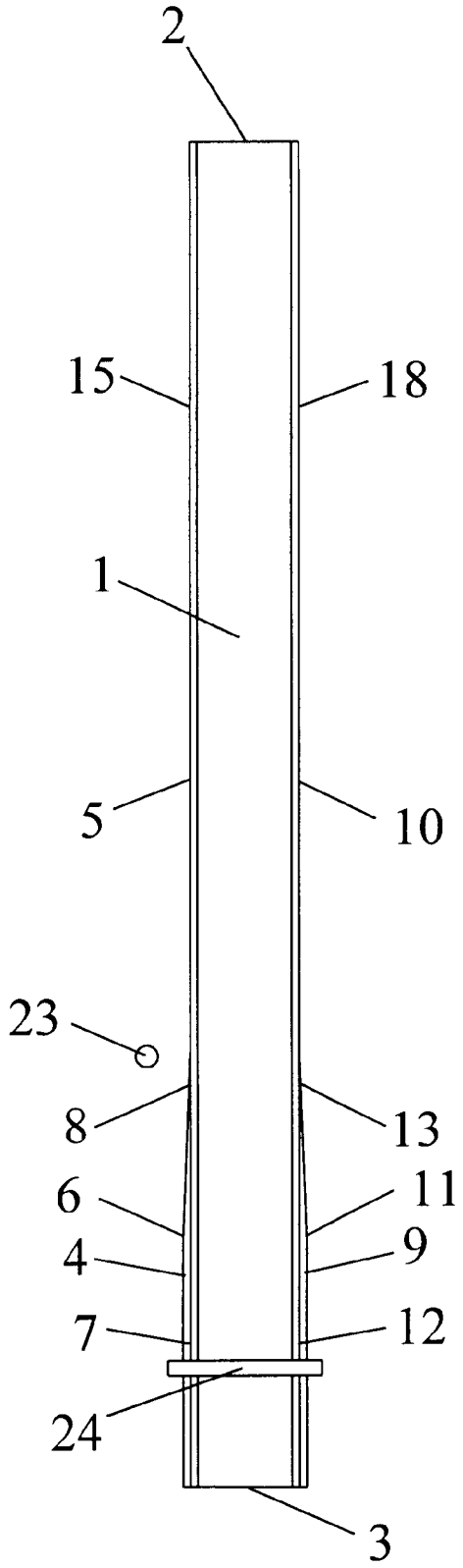
FIG. 5 is a view similar to that of FIG. 1 but adding to the embodiment of FIG. 1 a signal generator utilized to deactivate the throttle of the self-propelled vehicle and an auxiliary brake.

Preferably, a signal generator 23 is, as illustrated in FIG. 5, located near the track 1 between the beginning end 2 of the track 1 and the finish end 3 of the track 1. A sensor 37, illustrated in FIG. 3, on the self-propelled vehicle, which is preferably a non-contact sensor 37, is activated by a signal from the signal generator 23 when the self-propelled vehicle comes near to the signal generator 23. Activation of the sensor 37 deactivates—through any means that is well known in the art, such as an electrical relay—the throttle 39 of the self-propelled vehicle to aid in stopping the self-propelled vehicle.

Optionally, as also shown in FIG. 5, an auxiliary brake 24 may be installed on an open course to stop the self-propelled vehicle should the system for deactivating the throttle 39 of the self-propelled vehicle, the first brake pad 19, and the second brake pad 21 fail to function properly.

Figure 6:
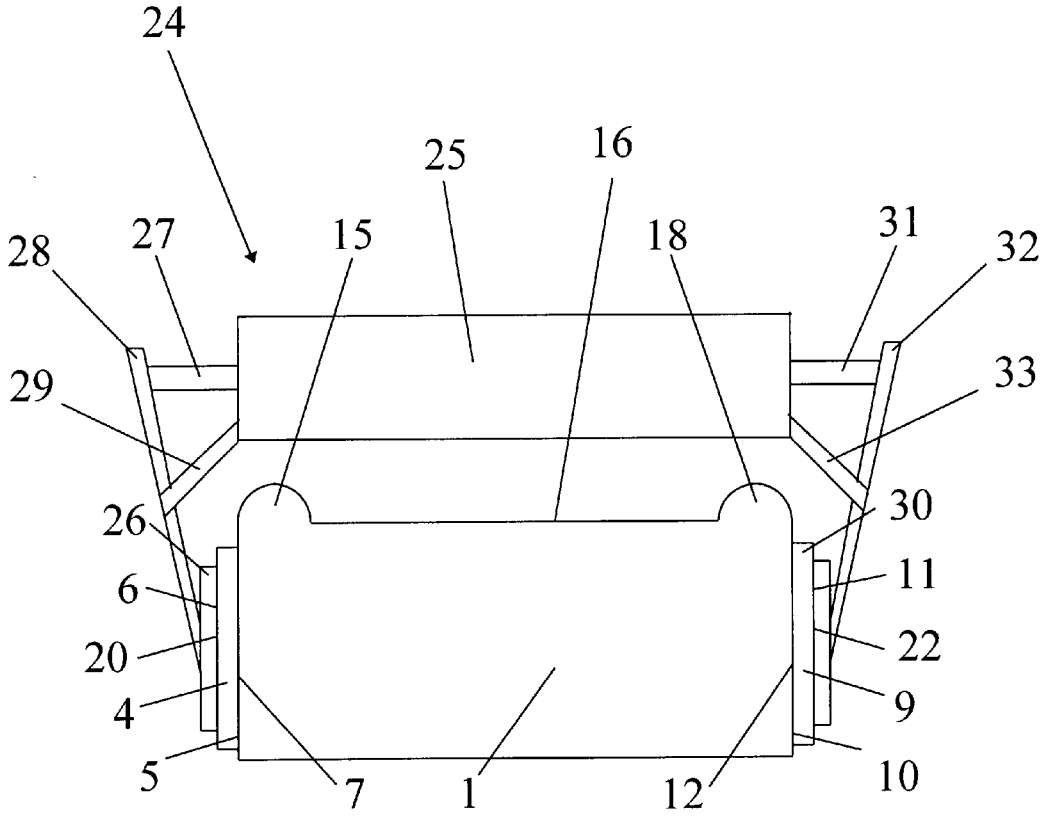
FIG. 6 is a transverse cross-sectional view illustrating the construction of the auxiliary brake.

The auxiliary brake 24 is composed, as illustrated in FIG. 6, of a bar 25 that fits across the track 1 together with a third brake pad 26 which is attached to the bar 25 in such a manner that the third brake pad 26 is urged in any manner that is well known in the art—for example, by a resilient member 27 such as a spring or air cylinder located between and attached to the bar 25 and a support 28 which is connected to the third brake pad 26 and pivotally attached to a diagonal support 29 that is rigidly attached to the bar 25—against the outer side 6 of the first frictional strip 4 to produce a frictional braking force and a fourth brake pad 30 which is attached to the bar 25 in such a manner that the fourth brake pad 30 is urged in any manner that is well known in the art—for example, by a second resilient member 31 such as a spring or air cylinder located between and attached to the bar 25 and a second support 32 which is connected to the fourth brake pad 30 and pivotally attached to a second diagonal support 33 that is rigidly attached to the bar 25—against the outer side 11 of the second frictional strip 9 to produce a frictional braking force. (Although not preferable, the fourth brake pad 30 could be replaced by a structurally similar device having less friction to be used primarily for structural support.)

Also optionally, a remote control may be incorporated to cause the self-propelled vehicle to operate in a reverse direction and return from a position near the finish end 3 of the track 1 to a position near the beginning end 2 of the track 1.

Finally, when a modified snowmobile is used as the self-propelled vehicle, it is preferable to incorporate a radiator into the snowmobile to prevent overheating otherwise caused by frequent use at temperatures higher than those in which snowmobiles are customarily operated.

The propulsive belt (not shown) of the snowmobile is preferably supported by, and moves along the top 16 of the track 1 between the first rail 15 and the second rail 18.

What is claimed is:

1. A racing amusement ride, which comprises:

a track having a beginning end, a finish end, a first lateral side, a second lateral side, and a top;

a self-propelled vehicle which moves along said track and has at least one guide wheel; and a throttle at least one rail situated on the top of said track along which the guide wheel of the self-propelled vehicle runs;

on at least one lateral side of said track, between the beginning end of the track and the finish end of the track, a frictional strip attached to said track; and a brake pad attached to said self-propelled vehicle by a means for urging said brake pad toward a lateral side of the track to which said frictional strip has been attached to such an extent that when the self-propelled vehicle is maintained in alignment with the track, the inner surface of said brake pad will attain a position, in the absence of the frictional strip, that is intermediate between the lateral side of the track and the position where the outer side of the frictional strip would be located were such frictional strip installed so that said brake pad and said frictional strip will decelerate the self-propelled vehicle.

2. The racing amusement ride as recited in claim 1, further comprising:

a signal generator located near said track between the beginning end of said track and the finish end of said track; and a sensor located on said self-propelled vehicle, said sensor being activated by a signal from the signal generator and said sensor including a means for deactivating the throttle of said self-propelled vehicle when said sensor has been activated.

3. The racing amusement ride as recited in claim 2, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

4. The racing amusement ride as recited in claim 1, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

5. The racing amusement ride as recited in claim 1, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

6. A racing amusement ride, which comprises:

a track having a beginning end, a finish end, a first lateral side, a second lateral side, and a top;

a self-propelled vehicle which moves along said track and has at least one guide wheel;

at least one rail situated on the top of said track along which the guide wheel of the self-propelled vehicle runs;

a signal generator located near said track between the beginning end of said track and the finish end of said track;

a non-contact sensor located on said self-propelled vehicle, said sensor being activated by a signal from the signal generator and said sensor including a means for deactivating the throttle of said self-propelled vehicle when said sensor has been activated; and an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

7. A racing amusement ride, which comprises:

a track having a beginning end, a finish end, a first lateral side, a second lateral side, and a top;

a self-propelled vehicle which moves along said track and has at least one guide wheel;

at least one rail situated on the top of said track along which the guide wheel of the self-propelled vehicle runs;

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

8. A racing amusement ride, which comprises:

a track having a beginning end, a finish end, a first lateral side, a second lateral side, and a top;

a self-propelled vehicle which moves along said track and has at least one guide wheel and a throttle;

at least one rail situated on the top of said track along which the guide wheel of the self-propelled vehicle runs;

a first frictional strip attached to a first lateral side of said track between the beginning end of the track and the finish end of the track;

a second frictional strip attached to a second lateral side of said track between the beginning end of the track and the finish end of the track;

a first brake pad attached to said self-propelled vehicle by a means for urging said brake pad toward the first lateral side of the track to such an extent that when the self-propelled vehicle is maintained in alignment with the track, the inner surface of said first brake pad will attain a position, in the absence of the first frictional strip, that is intermediate between the first lateral side of the track and the position where the outer side of the first frictional strip would be located were such first frictional strip installed so that said first brake pad and said first frictional strip will generate a frictional force which will decelerate the self-propelled vehicle; and a second brake pad attached to said self-propelled vehicle by a means for urging said brake pad toward the second lateral side of the track to such an extent that when the self-propelled vehicle is maintained in alignment with the track, the inner surface of said second brake pad will attain a position, in the absence of the second frictional strip, that is intermediate between the second lateral side of the track and the position where the outer side of the second frictional strip would be located were such second frictional strip installed so that said second brake pad and said second frictional strip will generate a frictional force which will decelerate the self-propelled vehicle.

9. The racing amusement ride as recited in claim 8, further comprising:

a signal generator located near said track between the beginning end of said track and the finish end of said track; and a sensor located on said self-propelled vehicle, said sensor being activated by a signal from the signal generator and said sensor including a means for deactivating the throttle of said self-propelled vehicle when said sensor has been activated.

10. The racing amusement ride as recited in claim 9, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

11. The racing amusement ride as recited in claim 8, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

12. The racing amusement ride as recited in claim 8, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

13. A racing amusement ride, which comprises:

a track having a beginning end, a finish end, a first lateral side, a second lateral side, and a top;

a self-propelled vehicle which moves along said track and has at least two guide wheels and a throttle;

a first rail situated on the top of said track, near the first lateral side of the track, along which first rail a guide wheel of the self-propelled vehicle runs;

a second rail situated on the top of said track, near the second lateral side of the track, along which second rail a guide wheel of the self-propelled vehicle runs;

on at least one lateral side of said track, between the beginning end of the track and the finish end of the track, a frictional strip attached to said track; and a brake pad attached to said self-propelled vehicle by a means for urging said brake pad toward a lateral side of the track to which said frictional strip has been attached to such an extent that when the self-propelled vehicle is maintained in alignment with the track, the inner surface of said brake pad will attain a position, in the absence of the frictional strip, that is intermediate between the lateral side of the track and the position where the outer side of the frictional strip would be located were such frictional strip installed so that said brake pad and said frictional strip will decelerate the self-propelled vehicle.

14. The racing amusement ride as recited in claim 13, further comprising:

a signal generator located near said track between the beginning end of said track and the finish end of said track; and a sensor located on said self-propelled vehicle, said sensor being activated by a signal from the signal generator and said sensor including a means for deactivating the throttle of said self-propelled vehicle when said sensor has been activated.

15. The racing amusement ride as recited in claim 14, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

16. The racing amusement ride as recited in claim 13, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

17. The racing amusement ride as recited in claim 13, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

18. A racing amusement ride, which comprises:

a track having a beginning end, a finish end, a first lateral side, a second lateral side, and a top;

a self-propelled vehicle which moves along said track and has at least two guide wheels;

a first rail situated on the top of said track, near the first lateral side of the track, along which first rail a guide wheel of the self-propelled vehicle runs;

a second rail situated on the top of said track, near the second lateral side of the track, along which second rail a guide wheel of the self-propelled vehicle runs;

a signal generator located near said track between the beginning end of said track and the finish end of said track;

a non-contact sensor located on said self-propelled vehicle, said sensor being activated by a signal from the signal generator and said sensor including a means for deactivating the throttle of said self-propelled vehicle when said sensor has been activated; and an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

19. A racing amusement ride, which comprises:

a track having a beginning end, a finish end, a first lateral side, a second lateral side, and a top;

a self-propelled vehicle which moves along said track and has at least two guide wheels;

a first rail situated on the top of said track, near the first lateral side of the track, along which first rail a guide wheel of the self-propelled vehicle runs;

a second rail situated on the top of said track, near the second lateral side of the track, along which second rail a guide wheel of the self-propelled vehicle runs; and an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

20. A racing amusement ride, which comprises:

a track having a beginning end, a finish end, a first lateral side, a second lateral side, and a top;

a self-propelled vehicle which moves along said track and has at least two guide wheels and a throttle;

a first rail situated on the top of said track, near the first lateral side of the track, along which first rail a guide wheel of the self-propelled vehicle runs;

a second rail situated on the top of said track, near the second lateral side of the track, along which second rail a guide wheel of the self-propelled vehicle runs;

a first frictional strip attached to a first lateral side of said track between the beginning end of the track and the finish end of the track;

a second frictional strip attached to a second lateral side of said track between the beginning end of the track and the finish end of the track;

a first brake pad attached to said self-propelled vehicle by a means for urging said brake pad toward the first lateral side of the track to such an extent that when the self-propelled vehicle is maintained in alignment with the track, the inner surface of said first brake pad will attain a position, in the absence of the first frictional strip, that is intermediate between the first lateral side of the track and the position where the outer side of the first frictional strip would be located were such first frictional strip installed so that said first brake pad and said first frictional strip will generate a frictional force which will decelerate the self-propelled vehicle; and a second brake pad attached to said self-propelled vehicle by a means for urging said brake pad toward the second lateral side of the track to such an extent that when the self-propelled vehicle is maintained in alignment with the track, the inner surface of said second brake pad will attain a position, in the absence of the second frictional strip, that is intermediate between the second lateral side of the track and the position where the outer side of the second frictional strip would be located were such second frictional strip installed so that said second brake pad and said second frictional strip will generate a frictional force which will decelerate the self-propelled vehicle.

21. The racing amusement ride as recited in claim 20, further comprising:

a signal generator located near said track between the beginning end of said track and the finish end of said track; and a sensor located on said self-propelled vehicle, said sensor being activated by a signal from the signal generator and said sensor including a means for deactivating the throttle of said self-propelled vehicle when said sensor has been activated.

22. The racing amusement ride as recited in claim 21, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

23. The racing amusement ride as recited in claim 20, further comprising:

a lever assembly mounted on said self-propelled vehicle to move said brake pad away from the lateral side of said track and to deactivate the throttle of said self-propelled vehicle; and an auxiliary throttle lever located on said self-propelled vehicle to open the throttle a sufficient amount to permit said self-propelled vehicle to return to an initial position of said self-propelled vehicle.

24. The racing amusement ride as recited in claim 20, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

25. The racing amusement ride as recited in claim 24, wherein:

the self-propelled vehicle is a snowmobile.

26. A process for amusement racing, which comprises:

moving a self-propelled vehicle which has at least one brake pad and at least one guide wheel along a track having a beginning end, a finish end, a first lateral side, a second lateral side, a top, at least one rail situated on the top of the track, and attached to the track a frictional strip on at least one lateral side of the track between the beginning end of the track and the finish end of the track;

guiding the self-propelled vehicle by having at least one guide wheel run along at least one rail;

urging at least one brake pad toward the lateral side of the track to which the frictional strip has been attached to such an extent that when the self-propelled vehicle is maintained in alignment with the track, the inner surface of said brake pad will attain a position, in the absence of the frictional strip, that is intermediate between the lateral side of the track and the position where the outer side of the frictional strip would be located were such frictional strip installed; and decelerating the self-propelled vehicle by permitting at least one brake pad to contact at least one frictional strip.

27. A process for amusement racing, which comprises:

moving a self-propelled vehicle which has at least two brake pads and at least two guide wheels along a track having a beginning end, a finish end, a first lateral side, a second lateral side, a top, a first rail situated on the top of the track near the first lateral side of the track, a second rail situated on the top of the track near the second lateral side of the track, a first frictional strip attached to the first lateral side of said track between the beginning end of the track and the finish end of the track, and a second frictional strip attached to a second lateral side of said track between the beginning end of the track and the finish end of the track;

guiding the self-propelled vehicle by having at least one guide wheel run along the first rail and at least one guide wheel run along the second rail;

urging at least one brake pad toward the first lateral side of the track to such an extent that when the self-propelled vehicle is maintained in alignment with the track, the inner surface of said brake pad will attain a position, in the absence of the first frictional strip, that is intermediate between the first lateral side of the track and the position where the outer side of the first frictional strip would be located were such first frictional strip installed;

urging at least one brake pad toward the second lateral side of the track to such an extent that when the self-propelled vehicle is maintained in alignment with the track, the inner surface of said brake pad will attain a position, in the absence of the second frictional strip, that is intermediate between the second lateral side of the track and the position where the outer side of the second frictional strip would be located were such first frictional strip installed; and decelerating the self-propelled vehicle by permitting at least one brake pad to contact the first frictional strip and permitting at least one brake pad to contact the second frictional strip.

* * * * *